United States Patent [19]

Hammer et al.

[11] Patent Number: 4,742,707

[45] Date of Patent: May 10, 1988

[54] DEVICE FOR FORMING A COAXIAL CORRUGATION IN A THIN-WALLED TUBE

[75] Inventors: Maximilian Hammer, Windach; Johann Münich, Munich; Ludwig Röhrl, Pasenbach, all of Fed. Rep. of Germany

[73] Assignee: MAN Technologie GmbH, Fed. Rep. of Germany

[21] Appl. No.: 16,549

[22] Filed: Feb. 19, 1987

[30] Foreign Application Priority Data

Feb. 20, 1986 [DE] Fed. Rep. of Germany ..... 3605440

[51] Int. Cl.[4] ..... B21J 9/18; B21D 39/08

[52] U.S. Cl. ..... 72/454; 72/57; 72/367; 72/393; 72/407

[58] Field of Search ..... 72/59, 57, 367, 393, 72/407, 408, 454

[56] References Cited

U.S. PATENT DOCUMENTS

| | | | |
|---|---|---|---|
| 2,773,538 | 12/1956 | De Mers . | |
| 2,796,106 | 6/1957 | Wood | 72/59 |
| 2,960,141 | 11/1960 | Rutter | 72/59 |
| 2,960,142 | 11/1960 | Cimochowski | 72/59 |
| 3,611,768 | 10/1971 | Odagaki . | |
| 4,319,471 | 3/1982 | Benteler et al. | 72/59 |

FOREIGN PATENT DOCUMENTS

| | | | |
|---|---|---|---|
| 706010 | 5/1941 | Fed. Rep. of Germany . | |
| 22721 | 12/1896 | United Kingdom | 72/59 |
| 1270672 | 12/1968 | United Kingdom . | |
| 1185437 | 3/1970 | United Kingdom . | |
| 1325759 | 12/1970 | United Kingdom . | |
| 1591476 | 1/1978 | United Kingdom . | |
| 2068810 | 11/1980 | United Kingdom . | |

OTHER PUBLICATIONS

Upset Beading Die Cuts Job Time 98%, American Machinist (1952) Oct. 13, p. 161.

*Primary Examiner*—Robert L. Spruill
*Assistant Examiner*—Donald R. Studebaker
*Attorney, Agent, or Firm*—Scully, Scott, Murphy & Presser

[57] ABSTRACT

For the production of coaxial corrugations in the walls of thin-walled tubes with very tight tolerances, the invention provides a device having jaws adapted to be moved equally in opposite directions and which press against the ends of the tube so as to have a corrugation formed therein so as to feed the tube wall axially towards the corrugation in the process of being generated. The jaws are moved by means of a central lead screw with screw threads of opposite hand.

8 Claims, 1 Drawing Sheet

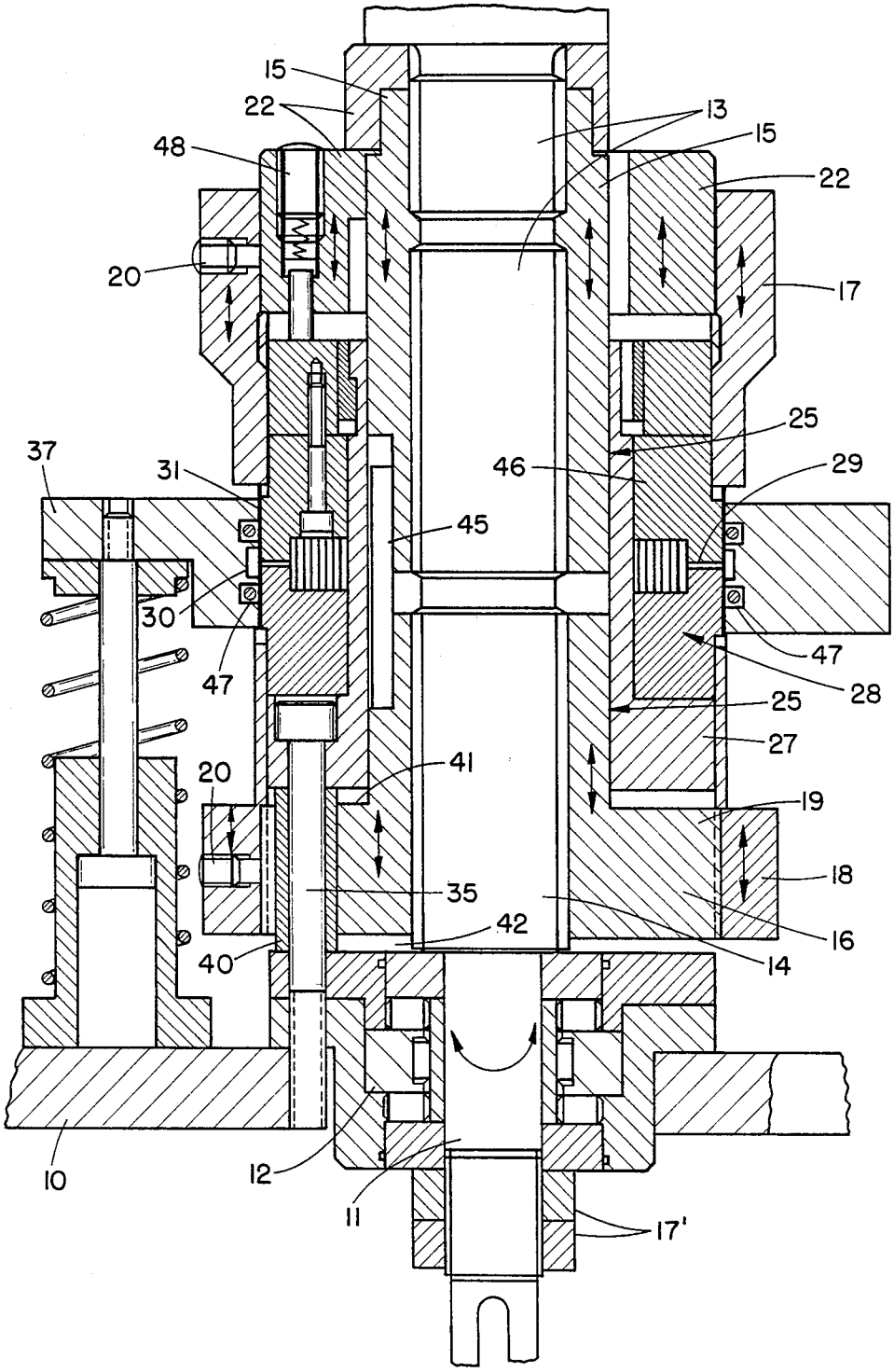
15
22
48
20
13
15
22
17
25
37
31
46
29
45
30
47
47
28
25
27
41
20
19
18
35
42
16
40
14
10
12
11
17'

DEVICE FOR FORMING A COAXIAL CORRUGATION IN A THIN-WALLED TUBE

BACKGROUND OF THE INVENTION

The invention relates to a device for forming coaxial corrugations in a thin-walled tube.

In the prior art such devices have been proposed comprising a mandril and at least one work forming member into which the wall of the tube may be pressed by a force, and holding jaws arranged around the mandril, of which at least one may be axially displaced during the corrugation forming operation in order to feed the wall into the forming member as the corrugation is being formed.

In one form of such a device designed on these lines, see the U.S. Pat. No. 2,773,538, there was a mandril in the form of a cylindrical head onto which the tube was slipped so as to be positioned within two annular holding jaws, of which pressed the tube against a stationary part of the cylindrical mandril fixed to the frame of the device, while the second holding jaw urged a second part of the tube onto the moving part of the cylindrical mandril. The moving part of the cylindrical mandril was moved together with the second holding jaw axially towards the first holding jaw. Owing to this and the action of internal pressure the tube was pressed outwards into a female forming member (constituted by the holding jaws when they were in engagement with each other) and with the creation of a coaxial corrugation.

Such a device may be used to form coaxial corrugations in hollow cylindrical members relatively quickly when there are no high expectations as regards dimensional accuracy.

SHORT SUMMARY OF THE INVENTION

One object of the present invention is to improve upon a device of the initially mentioned type so that it may be used to form coaxial corrugations within very tight tolerances.

In order to achieve this or other aims appearing herein, the device of the present invention is characterized in that there are jaws designed in the form of thrust rings and so arranged that they respectively engage the ends of the tube to be formed and are moved axially in opposite directions during formation of a corrugation.

In this device the jaws, designed in the form of the thrust rings, have the exclusive function of feeding the tube material as demanded by the corrugation forming process; the forming member is a separate component so that the deforming operation takes place with separate components. Thus it is not a question of the die only being assembled and formed when the corrugation is on the point of being formed as in the prior art.

In the previously proposed device the material is only fed from one end into the forming die. There is then necessarily an inclination of the cross section of the corrugation in the direction of thrusting so that the known method is not capable of producing a coaxial tube wall corrugation which is precisely symmetrical.

In fact, the device in accordance with the invention means that the material of the tube will be thrust and fed axially as the corrugation is formed so that an exactly symmetrical form of the corrugation section will be assured.

It has been found that the device in keeping with the invention may also be utilized for producing coaxial wall corrugations with secondary corrugations in their wall and within very tight tolerances. Such corrugations with secondary corrugations are herein taken to have at least two adjacent coaxial corrugations whose cross sections may be either outwardly or inwardly convex or of which one may be outwardly convex and the other outwardly concave.

In accordance with the invention the thrust rings are adapted to be mechanically operated.

Mechanical displacement of the thrust rings enables both tube ends to be displaced equally towards the die groove or gap for the corrugation to be formed, care only having to be taken to see that both the geometry of the system and also the coefficient of friction between the tube and the device components are substantially identical on the two sides.

This form of the invention enables better results to be produced than is possible with hydraulically operated axial thrust systems. It has in fact been seen that owing to the discontinuity between static and dynamic friction the end of the tube which is first to move does not cause the other or second tube end to slide simultaneously, since the same is still subject to static friction. The result is a slight impairment of symmetry which is still tolerable for many applications. However, very high degrees of accuracy may be obtained with mechanically driven thrust rings, in which case it is possible to ensure exactly simultaneous feed displacement of the two tube ends.

In order to ensure a precisely axial displacement of the thrust rings and the tube ends, the invention proposes a central drive for the thrust rings, which may simply take the form of a coaxial lead screw.

In this respect it is possible to either so design the axially moving thrust rings that they are directly screwed onto the lead screw, or they may be arranged so that they are not able to turn in relation to the forming member carrier. On turning the lead screw the thrust rings are axially displaced directly by the screw.

In keeping with a further form of the invention there are respective nuts between the lead screw and the axially moving thrust rings, such nuts being provided with means for preventing them from turning in relation to the forming member carrier. In this construction optimum connections may be incorporated for each individual application so that using such connections the parts, which have to be removed for removal and insertion of the tubes, may be simply fitted in position.

The nuts may at the same time be so designed that they peripherally bear the forming member or a carrier therefor and guide it axially.

The invention will now be described in more detail with reference to the single embodiment thereof, in the form of an upright device for forming inwardly extending corrugations in tube walls, shown diagrammatically in the drawing as a axial section.

DETAILED ACCOUNT OF WORKING EXAMPLE OF THE INVENTION

A lead screw 11 is mounted by means of a bearing 12 on a forming member carrier 10 so that it may rotate and be held in the bearing 12 by nuts 17'. The lead screw forms the axis of the device for forming coaxial corrugations in tubular workpieces. At one end thereof the lead screw 11 has a section 13 with, for instance, a right handed screw thread and at the other end it has a section 14 with a screw thread of opposite hand, i.e. a left handed thread. There are respective nuts 15 and 16 screwed onto the two threaded sections 13 and 14 on the lead screw 11. The nuts 15 and 16 serve to hold and axially displace thrust rings 17 and 18. The thrust ring 18 is screwed onto a flange 19 on the nut 16 and is locked in place by a radial screw or pin 20. The second thrust ring 17 is connected with the nut 15 by way of a bayonet coupling 22. To allow for play of the nut 15 there is a backlash take-up device 48. The bayonet coupling 22 makes it possible for the second thrust ring 17 to be rapidly removed and mounted on the device.

The plain outer faces of the nuts 15 and 16 serve to support and guide a sleeve-like carrier 27 for a two-part corrugation forming member 28 and 46 in the form of a female die member, which has an annular female groove 29 for the formation of a tube wall corrugation. By way of one or more screws 35 the die member or forming member 28 and 46 is prevented from turning in relation to the frame of the device. These screws are screwed into the forming member carrier 10.

The device is furthermore fitted with an annular member 37 having a small pressure chamber 30 which surrounds the tube 31 to be formed and which is sealed off on both axial sides by o-rings 47 in grooves in the member 37 so that the rings engage the outer faces of the members 28 and 46 respectively.

For producing a coaxial corrugation in a tube the thrust ring 17 on the free end of the lead screw 11 is removed by undoing the bayonet coupling 22, and the member 37 defining the pressure chamber 30 is slipped onto the lower thrust ring 18. When this happens the pressure chamber 30 is kept closed all the time, which is an advantage inasfar as the venting is not necessary when the workpiece is removed and a new one mounted on the device. It is now possible for the tube 31 to have a corrugation formed in its wall to be slipped over the die member 28 and 46 so that it abuts a collar on the top end of a sleeve running up from and forming part of the thrust ring 18.

After this the member 37 defining the pressure chamber 30 is slipped upwards onto the tube 31 and the thrust ring 17, which had been initially removed, is replaced. By means of a pipe system which is not specially illustrated, the pressure chamber 30 is put under pressure and after the application of such pressure the lead screw 11 is turned so that the nut 16 riding on the section 14 of the lead screw is moved axially towards the middle of the lead screw because the axis-parallel screw 35 prevents the nut 16 turning with the lead screw, i.e. from turning in relation to the forming member carrier 10. The screw 35 is within in a plain bushing 40 in the flange 19 on the nut 16. The plain bushing 40 protrudes axially from both sides of the nut flange 19 to serve as a distance piece for the die carrier 27 in such a way that the gaps 41 and 42 as necessary for the axial motion of the nut 16 remain in existence. The outer face 25 slides on the inner face of the die carrier 27.

There are slides 45 running in axis-parallel grooves in the two nuts 15 and 16 in order to prevent the second nut 15 rotating in relation to the first nut 16. Accordingly the opposite thread on the upper section 13 of the lead screw causes the upper nut 15 and therefore also the respective thrust ring 17 to move towards the other thrust ring 18. The oppositely directed axis-parallel motion of the thrust rings 17 and 18 is powered by a drive (not illustrated) and epicyclic or worm gearing with a substantial step-down ratio. Owing to these mechanical movement and to the pressure in the pressure chamber 30 the material of the wall of the tube 31 is fed and pressed into the coaxial die groove 29 defined in the die member 28 and 46. Due to the pressing of the tube material from both ends exactly simultaneously and even owing to the use of the lead screw towards the corrugations, the latter is formed with a high precision as regards symmetry, the outline of the corrugation being determined by the die groove 29 of the die member 28 and 46.

To remove the deformed tube 31 the upper thrust ring 17 is firstly dismounted, by releasing the bayonet coupling 22, and together with the upper section 46 of the die member 28 and 46 and the member 37 of the pressure chamber 30 is pushed downwards.

The device which is shown as being upright in the drawing may naturally also be arranged and used in a horizontal position. The device may furthermore be used to produce outwardly bulging corrugations and compound corrugations of the most various kinds. For each individual type of coaxial corrugation a different respective die member or a pair of associated die members is required. The hydraulic pressure may either be supplied to the tube from the inside or from the outside or in both these directions. Whatever the outline of the coaxial corrugation the feed of the tube material is ensured by means of two simultaneously and oppositely moving jaws, the arrangement and its drive being as in the drawing or in any other suitable way.

If the tolerances are not very tight, it is possible for the jaw rings 17 and 18 to be hydraulically operated, but then the feed of one jaw may be delayed so that there will be a slight degree of asymmetry in the corrugation outline. Such out of step operation of the jaw rings 17 and 18 is avoided if the drive is mechanical. It is only necessary to take care to see that at the two parts of the tube the geometry and the coefficients of friction at the pressure chamber seals 47, on the die member 28 and 46 and on the tube 31 are substantially identical.

What is claimed is:

1. A device for forming a coaxial corrugation in a thin-walled tube, comprising:

a. A mandril around which a tube is placed;

b. at least one forming member having a female groove therein, into which the tube wall is pressed, said groove being coaxial with said mandril;

c. jaws arranged around the mandril, said jaws being axially displaceable during the formation of said corrugation, said jaws including thrust rings which axially engage opposite radial ends of the tube; and d. means for moving said thrust rings axially towards each other during the formation of the coaxial corrugation, said moving means including a coaxially and centrally arranged lead screw with oppositely threaded screw sections for driving said thrust rings, and each thrust ring engaging the lead screw at an oppositely threaded screw section, such that rotation of the thrust screw moves said thrust rings towards each other.

2. The device as claimed in claim 1, comprising a forming member carrier, said axially moving thrust rings having means for preventing rotation of said thrust rings relative to said forming member carrier.

3. The device as claimed in claim 2, wherein said thrust rings comprise nuts which are screwed onto said lead screw to connect said thrust rings with the lead screw and to cause axial motion of said thrust rings when said screw revolves.

4. The device as claimed in claim 1, wherein said forming member is in sliding engagement with an outer face of said lead screw for movement therealong.

5. The device as claimed in claim 2, wherein said forming member carrier is in sliding engagement with an outer face of said lead screw.

6. The device as claimed in claim 3, wherein said forming member is in sliding engagement with an outer face of said nuts for movement therealong.

7. The device as claimed in claim 3, wherein said forming member carrier is in sliding engagement with an outer face of said nuts for movement therealong.

8. The device as claimed in claim 3, comprising a backlash compensating means associated with at least one of said nuts to compensate for nut play.

* * * * *